United States Patent [19]

Auer et al.

[11] Patent Number: 4,949,466

[45] Date of Patent: Aug. 21, 1990

[54] DRAWING DEVICE HAVING INDEXABLE STYLUS TURRET

[75] Inventors: Robert T. Auer, East Stroudsburg, Pa.; Richard J. Mayer, Parsippany, N.Y.; Jore M. Chung, Jackson, N.J.

[73] Assignee: Buddy L Corporation, New York, N.Y.

[21] Appl. No.: 343,897

[22] Filed: Apr. 26, 1989

Related U.S. Application Data

[63] Continuation-in-part of Ser. No. 193,879, May 13, 1988, Pat. No. 4,856,197.

[51] Int. Cl.[5] ..... B43L 13/00

[52] U.S. Cl. ..... 33/18.1; 33/1 M; 33/23.03; 346/139 R

[58] Field of Search ..... 33/1 M, 18.1, 23.03, 33/38, 39.1; 346/21

[56] References Cited

U.S. PATENT DOCUMENTS

| | | | |
|---|---|---|---|
| 519,953 | 5/1894 | Henry | 33/18.1 |
| 1,641,199 | 9/1927 | Roucka | 346/46 |
| 2,082,591 | 6/1937 | Newman | 346/140 A |
| 2,701,417 | 2/1955 | Graham | 33/18.1 |
| 3,351,949 | 11/1967 | Brown | 346/141 |
| 3,761,949 | 9/1973 | Hasebe | 346/46 |
| 4,135,303 | 1/1979 | Gresset | 33/18.1 |
| 4,369,579 | 1/1983 | Mizoule | 33/18.1 |
| 4,550,503 | 11/1985 | Klawitter | 33/18.1 |
| 4,577,409 | 3/1986 | Sakamoto et al. | 33/18.1 |

OTHER PUBLICATIONS

Streifler, J. J., "Plastic Scribing" *Photogrammetric Engineering*, Apr. 1957, vol. 23, no. 2, pp. 330–335.

*Primary Examiner*—Thomas B. Will

*Attorney, Agent, or Firm*—Michael Ebert

[57] ABSTRACT

A drawing device adapted to produce line drawings or sketches on a transparent screen on top of a case partly filled with a powder that adheres slightly to the undersurface of the screen to render it opaque. Disposed within the case are transverse and longitudinal rods operatively coupled to respective control knobs, one of which, when turned, causes the longitudinal rod to shift toward either side of the case, the other of which, when turned causes the transverse rod to shift to either end of the case. Supported at the intersection of the rods is an indexable stylus turret and carrier assembly whose carrier is slidably supported on the transverse rod and whose stylus turret which is received within the carrier, is slidably supported on the longitudinal rod whereby the position occupied by the assembly is determined by the point of intersection. The turret is indexable to present to the underside of the screen, for scraping powder therefrom to draw a line, any one of three styluses each producing a line of different width or character or to present a blank stylus which interrupts the drawn line. Indexing is effected by pressing an actuator bar operatively coupled to the longitudinal rod carrying the turret to depress this rod and to cause a turret pin to engage an abutment in the carrier, this action causing the turret to index to its next operative position.

9 Claims, 4 Drawing Sheets

Fig. 1.
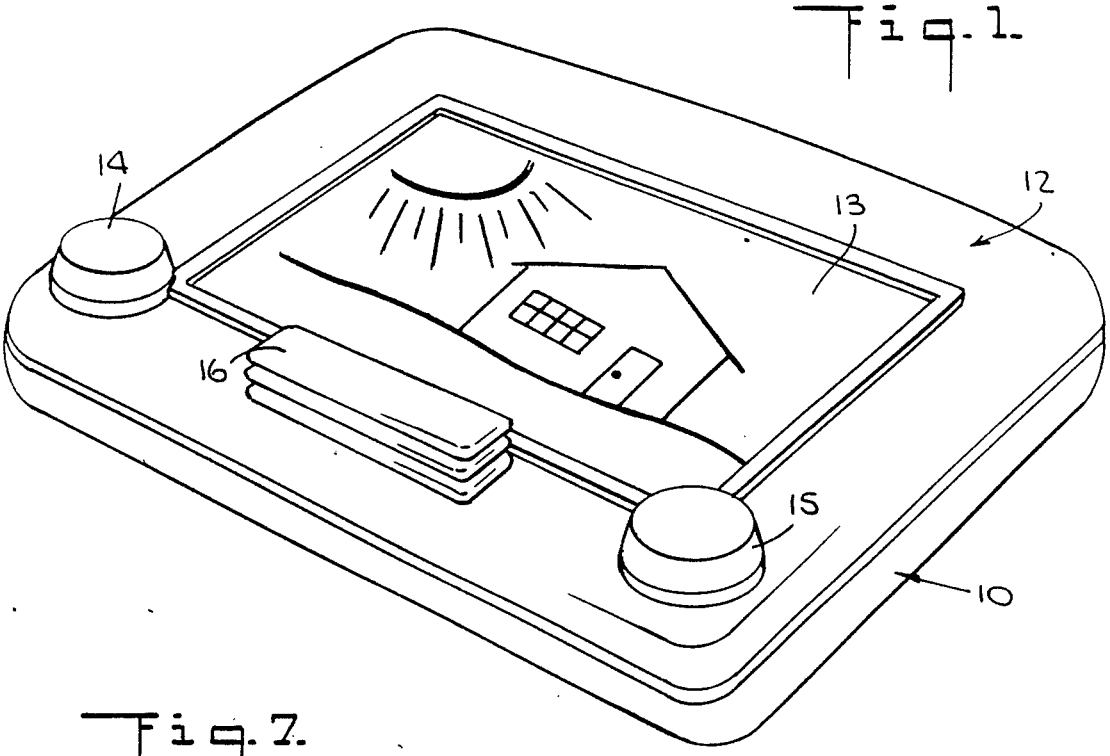
Fig. 7.
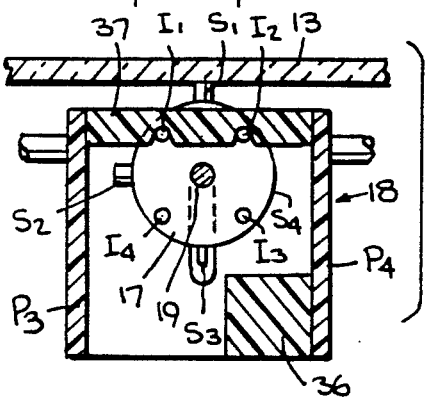
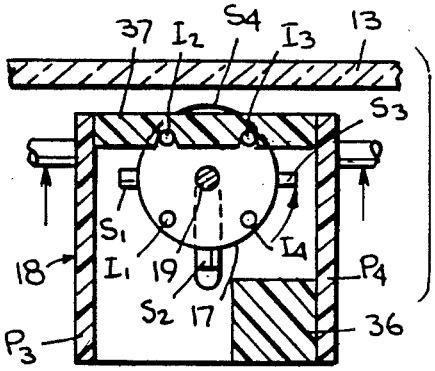
Fig. 9
Fig. 8.
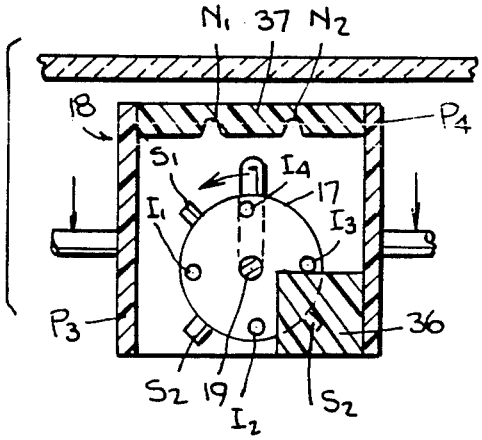

Stylus Turret
10
11
14S
15S
16
17
18
19
20
21
22
24
25
28
29
30
31
32
32A
32B
33
33A
33B
34
35
38
39
40
41
R1
R2
R3
R4
P1
P2
P3
W1
W2
W3
W4
L1
L2
L3
L4
L5
L6
T1
T2
T3
T4

DRAWING DEVICE HAVING INDEXABLE STYLUS TURRET

Related Application

This application is a continuation-in-part of our copending patent application Ser. No. 193,879, filed May 13, 1988, entitled "Drawing Device Having Retractable Stylus," the entire disclosure of which is incorporated herein by reference now U.S. Pat. No. 4,856,197.

BACKGROUND OF INVENTION

1. Field of Invention

This invention relates generally to a drawing device having a shiftable stylus adapted to draw on the undersurface of a screen rendered opaque by powders, various line drawings or sketches whose contours depend on the operator-controlled path taken by the stylus as it scrapes powder from the screen, and more particularly to a drawing device of this type which includes a stylus turret which is indexable to present to the underside of the screen any one of a plurality of styluses to draw a line or group thereof whose character depends on the operative stylus or to present a blank stylus to interrupt the weak line being drawn.

2. Status of Prior Art

The Grandjean patent No. 3,305,113, and the Clark patent No. 3,760,505, disclose a tracing device having educational as well as play value. The tracing device includes a box-like case having a transparent glass plate or screen below which are left and right control knobs. By turning these knobs, one can delineate on the screen various letters, charts, designs and other line drawings and sketches.

In a tracing device of this type, one well known version which is commercially available under the trademark Etch-A-Sketch, in order to form a horizontal line in the X-direction on the screen, the operator has only to turn the left knob, while to form a vertical line in the Y direction, he turns the right knob. And to create curves and angles on the screen, these knobs are concurrently turned, thereby causing the stylus to shift in a path which is the vector resultant of the X and Y movements. The terms "drawing" and "tracing" as used herein are interchangeable, as are the terms "shiftable" and "movable."

The case is partly filled with a slightly adhesive powder which sticks onto the undersurface of the screen to render it opaque but is easily dislodged therefrom. The undersurface of the screen is engaged by the movable stylus which under knob control scrapes powder from the screen to define a line whose contour depends on the operator-controlled path taken by the stylus.

To erase the line drawing or sketch defined by the scraped-off powder on the screen, the case is turned upside down and is shaken to cause the powder to cascade over the undersurface of the screen, to again form an opaque coating.

The later-issued Clark patent differs from the earlier Grandjean patent mainly in the means incorporated therein to prevent leakage of powder from the tracing device. Both patents make use of transverse and longitudinal rods at whose intersection the stylus is mounted for sliding movement. The transverse rod is fastened at its extremities to parallel sections of a first string loop operatively coupled to the left control knob so that as this knob is turned, the transverse rod and the stylus borne thereby are caused to move toward either end of the box, depending on the direction of knob rotation, thereby drawing a horizontal line on the screen. The longitudinal rod is fastened at its extremities to parallel sections of a second string loop operatively coupled to the second knob so that as this knob is turned, this rod and the stylus borne thereby are caused to move toward either side of the box, thereby drawing a vertical line on the screen.

Thus, operation of one knob produces a line in the X-direction on the screen, operation of the other knob produces a line in the Y-direction, and concurrent turning of the knobs produces a line in a Z-direction which is the vector resultant of the X and Y movements of the stylus. The drawing device is therefore capable of creating line drawings or sketches having a desired configuration.

The most serious practical limitation of the tracing device of the type disclosed in the Clark and Grandjean patents as well as in commercially-available devices based on these patents is the inability of these devices selectively to interrupt the line drawn by the stylus. The stylus is urged against the undersurface of the screen under the tension of the string loops supporting the intersecting rods on which the stylus is mounted, and the stylus is never retracted therefrom. Because of this limitation, whatever drawing or sketch is traced on the screen by the operator must be formed by unbroken or continuous lines.

To explain why this limitation is troublesome, let us assume that a child wishes to draw with a pencil a simple picture composed of a house at ground level above which is the sun, a cloud and an airplane. These elements of the picture are all discrete and separated from each other in space. If, now, the child wishes to draw the same picture on a standard drawing device in which the stylus effectively performs the function of a pencil, he cannot on the screen of the drawing device create the elements thereof in discrete form, for the stylus never leaves the screen.

Hence, after completing, say, the house, in order now to draw the sun the child must trace a line from the house to a point thereabove before outlining the sun, and do likewise when going from the sun to a cloud, and from the cloud to an air plane. As a consequence, the picture is impaired by connecting lines which serve no artistic purpose but are dictated by the limitations of the tracing device. And when the child wishes with the tracing device to print on the screen an expression such as HAPPY BIRTHDAY, the letters cannot be separately traced but must be joined together as in cursive writing. Thus, however the knobs are manipulated, the operator can never lift the stylus from the screen as one can lift a pencil from paper.

Our above-identified patent Ser. No. 4,856,197 discloses a drawing device whose stylus is capable of being moved under the control of X-direction and Y-direction knobs to create on a screen various line drawings and sketches having any desired contour, the device further including a manually-operated interrupter mechanism which when actuated acts to retract the stylus from the screen without inhibiting movement of the stylus under knob control. This arrangement makes possible the formation on the screen of a drawing or sketch composed of discrete, multiple elements without the need to interconnect these elements with lines as in prior tracing or drawing devices.

In the drawing device disclosed in patent No. 4,856,197, disposed within the case is a stylus supported for sliding movement at the intersection of shiftable transverse and longitudinal rods. The moving stylus normally engages the undersurface of the screen and acts to scrape powder therefrom to create a line whose contour depends on the path taken by the stylus under the control of one or both knobs. In order to produce sketches and drawings having discrete elements, a manually-operated interrupter mechanism is provided which when actuated depresses one of the rods to retract the stylus from the screen without, however, inhibiting shifting thereof, whereby it then becomes possible selectively to interrupt the line drawn thereby.

Of prior art interest with respect to retractable styluses are the patents to Gresset Nos. 4,135,303, and Klawitter, 4,550,503.

The limitations of prior drawing devices of the above-described type is that they are capable only of producing sketches or drawings in which the lines all have exactly the same thickness. From the artistic standpoint, this restricts the expressive range of the drawing device, and it is as if an artist were required to work always with a pencil or crayon that has a fixed fine point, so that he could not produce lines of medium or gross thickness and thereby be able to highlight certain features and attenuate others.

SUMMARY OF INVENTION

In view of the foregoing, the main object of this invention is to provide a drawing device capable of drawing lines of different thickness or character by scraping powder from the undersurface of a screen rendered opaque by powder.

More particularly, an object of this invention is to provide a drawing device having a shiftable stylus for drawing on the undersurface of a screen rendered opaque by powder, the stylus scraping powder from the screen to produce line drawings whose contours depend on the operator-controlled path taken by the stylus, the device including an indexable stylus turret to present to the underside of the screen any one of a plurality of styluses or to present a blank stylus to interrupt the drawn line.

A significant advantage of the invention is that the operator of the drawing device has selectively available several styluses, each producing a distinctive line of predetermined thickness or a group of lines, so that in making a drawing, the operator can vary the character of the drawn line and thereby enhance the expressive nature of the drawing.

Also an object of this invention is to provide a drawing device of the above type which includes a pair of control knobs by which the operator can shift an indexable stylus turret in the X and Y directions or in a direction which is the vector resultant of X and Y movement, the turret being indexed by an actuator accessible to the operator to present to the screen a stylus of the desired character.

Still another object of the invention is to provide a drawing device whose screen is protectively covered by a transparent plastic sheet, whereby should the screen shatter as a result of an accident, the particles thereof will remain within the device.

Briefly stated, these objects are attained in a drawing device adapted to produce line drawings or sketches on a transparent screen on top of a case partly filled with a powder that adheres slightly to the undersurface of the screen to render it opaque. Disposed within the case are transverse and longitudinal rods operatively coupled to respective control knobs, one of which, when turned, causes the longitudinal rod to shift toward either side of the case, the other of which, when turned, causes the transverse rod to shift to either end of the case.

Supported at the intersection of the rods is an indexable stylus turret and carrier assembly whose carrier is slidably supported on the transverse rod and whose stylus turret which is received within the carrier is slidably supported on the longitudinal rod whereby the position occupied by the assembly is determined by the position of the intersection. The turret is indexable to present to the underside of the screen, for scraping powder therefrom to draw a line, any one of several styluses each producing a line of different width or character or to present a blank stylus which interrupts the drawn line. Indexing is effected by pressing an actuator bar operatively coupled to the longitudinal rod carrying the turret to depress this rod and to cause a turret pin to engage an abutment in the carrier, this action turning the turret to its next operative position.

BRIEF DESCRIPTION OF DRAWINGS

For a better understanding of the invention as well as other objects and further features thereof, reference is made to the following detailed description to be read in conjunction with the accompanying drawings, wherein:

FIG. 1 shows, in perspective, a drawing device in accordance with the invention;

FIG. 7 is a section taken through the indexable stylus turret and carrier assembly when one of the styluses engages the undersurface of the screen;

FIG. 8 is a section as in FIG. 7 showing the stylus turret when it is fully retracted with respect to the screen;

FIG. 9 is a section as in FIG. 7 showing the stylus turret after it has moved from its fully retracted state upwardly toward the screen;

DESCRIPTION OF INVENTION

The Basic Assembly

Figures 2, 10, 11:
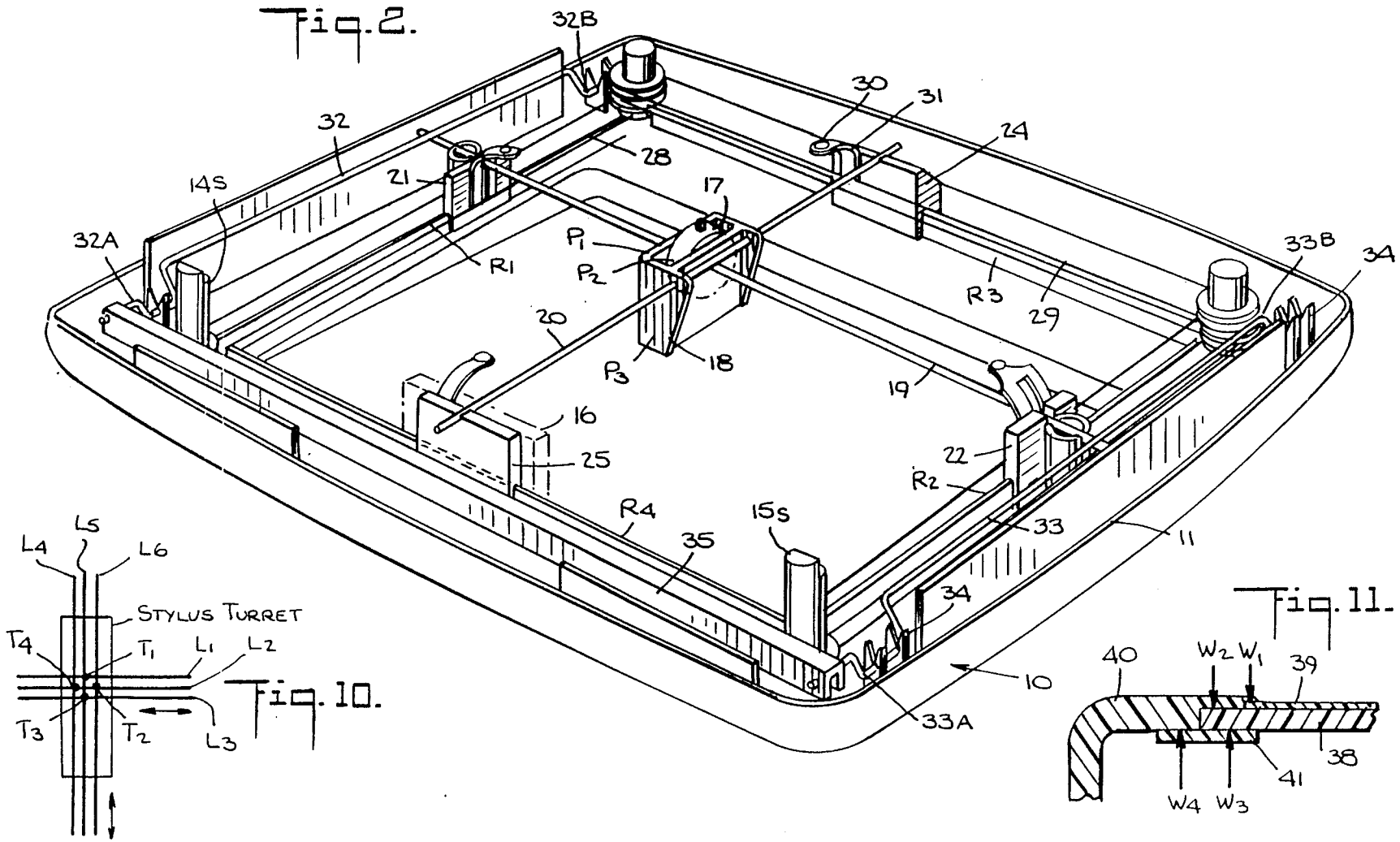
FIG. 2 illustrates in plan view the base tray of the device and the string loops for manipulating the rods supporting the indexable stylus turret and carrier assembly.
FIG. 10 shows a stylus formed by four tips at the corners of a diamond to produce a cluster of three parallel lines in the X or Y direction.
FIG. 11 is a sectional view of the screen portion of a drawing device having a protective transparent sheet covering the screen.
Figure 3:
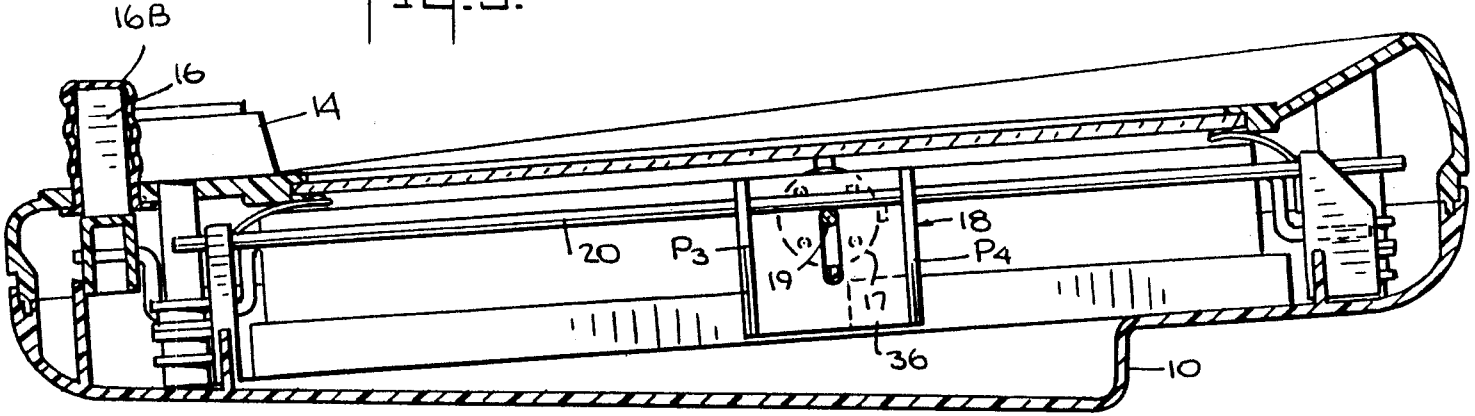
FIG. 3 is a transverse section taken through the drawing device showing a selected stylus in engagement with the undersurface of the screen.
Figure 4:
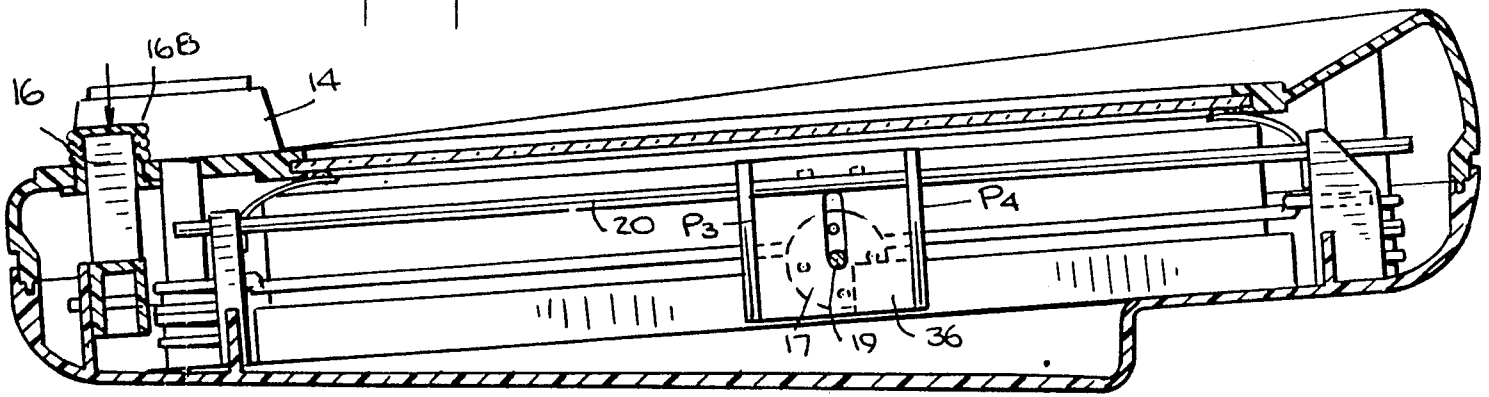
FIG. 4 is a transverse section showing the retracted relationship of the indexable stylus turret to the screen when the actuator therefor is operated.

Referring now to FIGS. 1 and 2, there is shown a drawing device in accordance with a preferred embodiment of the invention. The device includes a rectangular base tray 10 molded of synthetic plastic material of high strength, such as ABS or high-impact polystyrene. The tray is provided with a peripheral groove 11 adapted to snugly receive a complementary flange formed on the undersurface of a frame-shaped cover 12 made of similar plastic material. Mounted within the frame of cover 12 is a transparent plate 13 formed of glass or similar clear material functioning as the screen of the device.

The drawing device is provided at positions on cover 12 below screen 13 with a left control knob 14 which when turned produces a horizontal line in the X-direction, and a right control knob 15 which when turned produces a vertical line in the Y-direction. When the two knobs are operated concurrently, the vector resultant of the stylus movements produces a line in a diagonal direction.

Also included intermediate the left and right control knobs is an actuator bar 16, shown in dotted lines in FIG. 2, covered by a flexible plastic bellows 16B. When pressed down by the user, bar 16 operates an indexing mechanism which acts to index a stylus turret 17 supported in a turret carrier 18.

Screen 13 is marginally supported snugly within a molded groove in cover frame 12. The cover frame 12, when joined to the tray 10, is sealed thereto to create a fluid-tight enclosure. This enclosure is partly filled with a powder (not shown) of the type disclosed in the Grandjean and Clark patents. The control knob shafts 14S and 15S which go through bores in cover frame 12 are provided with suitable sealing gaskets to prevent powder leakage through these openings.

In practice, the powder may be a fine metallic powder mixed with small plastic beads to form a mixture that can be shaken up within the enclosure without escaping therefrom. The powder has slightly adhesive properties and therefore, when the device is shaken up in an upside-down state, coats the undersurface of the screen to render it opaque. And when the device is put to use and lines or marks are left on the screen by the operative stylus which scrapes off the powder, the resultant lines or marks may be erased by again shaking up the device in an upside-down state, thereby again rendering the screen opaque in readiness for a new drawing.

As shown in FIG. 2, indexable turret 17, which is disc-shaped, is supported between the parallel side panels $P_1$, $P_2$ of carrier 18, the carrier being completed by end panels $P_3$ and $P_4$ joined to the side panels to define a cavity. Turret 17 is slidable on a longitudinal rod 19 which goes through a center bore in the turret. Longitudinal rod 19 intersects a transverse rod 20 which passes through aligned bores in the end plates $P_3$ and $P_4$ of carrier 18, so that the carrier is slidable on transverse rod 20. Thus the assembly constituted by indexable turret 17 and carrier 18 is positioned at the intersection of rods 19 and 20, and as the point of this intersection is changed, the position of the assembly is likewise changed.

Figure 5:
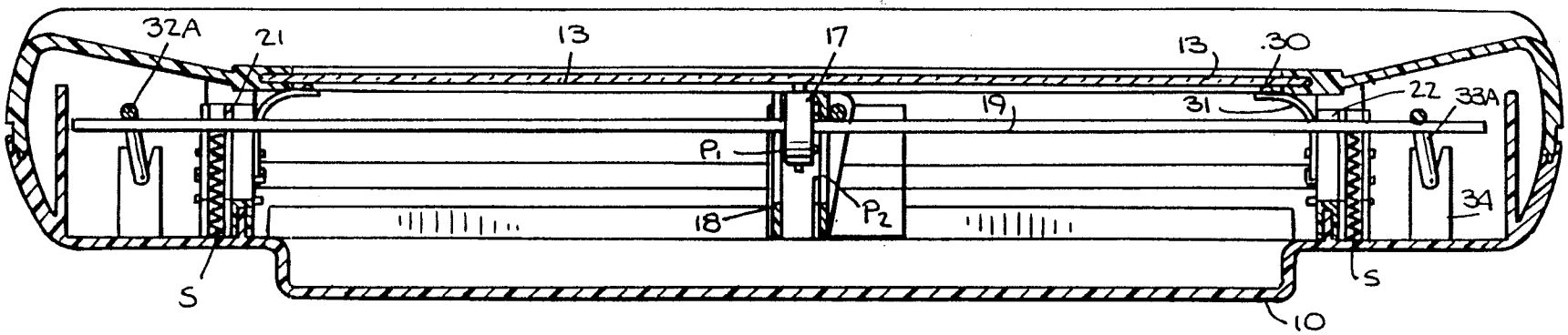
FIG. 5 is a longitudinal section taken through the drawing device showing a selected stylus in engagement with the undersurface of the screen.
Figure 6:
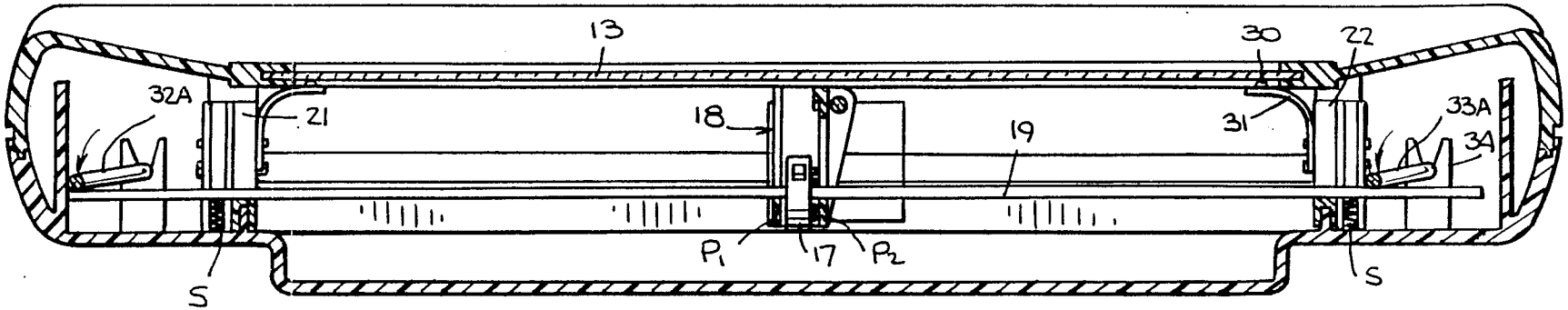
FIG. 6 is a longitudinal section taken through the drawing device showing the stylus turret in its retracted state.

Riding on parallel rails $R_1$ and $R_2$ adjacent opposite ends of base tray 10 are slides 21 and 22, the slides having vertical slots therein which receive the opposing end portions of longitudinal rod 19. Integral with the rear of slides 21 and 22 are correspondingly-slotted cylinders, each housing a compressible helical spring S (see FIGS. 5 and 6), thereby making it possible to depress rod 19 against the tension of the springs. Since rod 19 carries turret 17, depression of this rod causes the turret to drop within the cavity of carrier 18.

Riding on parallel rails $R_3$ and $R_4$ adjacent the opposite sides of tray 10 are slides 24 and 25. These slides are provided at their upper edges with notches through which pass the end portions of transverse rod 20. Hence rod 20 is not depressible and carrier 18 is at a fixed position relative to the depressible turret 17 received in its cavity.

Slides 21 and 22 are fastened to parallel branches of a first continuous string loop 28. This string loop is looped around a set of pulleys mounted for rotation adjacent the four corners of the tray, one of these pulleys being a drive pulley mounted on shaft 15S of the right control knob 15. Thus when this knob is turned, longitudinal rod 19 supported on slides 21 and 22 is shifted toward either side of tray 10, depending on the direction of rotation.

Slides 24 and 25 are fastened to parallel branches of a second continuous string loop 29 looped around another set of four pulleys, one of these pulleys being a drive pulley mounted on shaft 14S of left control knob 14. Hence when this knob is turned, transverse rod 20 supported by slides 24 and 25 is shifted toward either end of tray 10, depending on the direction of knob rotation.

The manner in which the longitudinal and transverse rods are shifted in the X and Y directions to vary the position of the stylus turret and carrier assembly which is at the intersection of the rods is essentially the same as 17 in the string arrangement disclosed in our copending patent application and in the Clark and Grandjean patents, above identified, and therefore will not further be detailed.

When turret 17 is indexed to present a selected stylus, its peak is pressed against the undersurface of screen 13. Hence as rods 19 and 20 are manipulated by the strings to shift the stylus, the stylus then scratches off the powder adhered to the undersurface of the screen, thereby making the screen transparent along the powder-free line. Because the user looks into a dark sealed case through the scratch lines, these lines, in contrast to the color of the opaque powder, which may be colored silver, gold or copper, appear to be black and are therefore clearly visible on the screen.

Since the indexable stylus turret also includes a blank stylus to interrupt the line being drawn, in order for the user of the device to be able to determine where the turret and carrier assembly is located when a particular line is being interrupted, each slide such as slide 24 is provided with a guide stylus 30 supported at the free end of a curved arm 31 of flat plastic. spring cantilevered from the slide. Stylus guide 30 engages the undersurface of the glass plate and draws a line on the plate along the edge thereof parallel to the slide path.

The Indexing Mechanism

The extremities of longitudinal rod 19 which carries turret 17 lie under a pair of parallel crank rods 32 and 33 adjacent opposite ends of tray 10. Each crank rod terminates at its opposite ends in crank arms 32A and 32B and 33A and 33B, respectively, each of which is supported in a bearing 34 having a V-shaped slot to receive the crank arm. The ends of crank arms 32A and 33A are pivotally connected to opposite ends of a beam 35, the actuator bar 25 resting on the midpoint of this beam.

When, therefore, actuator bar 25 is depressed, it pushes down beam 35 which, because it is supported at its ends by crank arms 32A and 33A, causes these arms to swing, and in doing so to pull down crank rods 32 and 33. Crank rods 32 and 33, which overlie the opposite ends of transverse rod 19, as it is lowered, act to depress this rod and in doing so to depress stylus turret 17 to effect an indexing action.

As shown in FIGS. 3 to 6, when longitudinal rod 19 is in its raised position, a selected stylus on turret 17 is then in engagement with glass plate 15. But when crank arms 32A and 33A are swung down to depress rod 19 against the tension of springs S in slides 21 and 22, to effect an indexing action, the turret is then retracted with respect to the glass plate, the turret then dropping within the cavity of carrier 18.

As shown in FIGS. 7 to 9, stylus 17 is provided at equi-spaced positions along its periphery at 90 degree intervals with a first stylus $S_1$, a second stylus $S_2$, a third stylus $S_3$ and a blank stylus $S_4$. Styluses $S_1$, $S_2$, and $S_3$ have a different thickness or character to draw a distinctive line depending on the stylus which is in operative relation to the underside of glass plate 13.

On one side of the disc-shaped turret 17 are indexing pins $I_1$, $I_2$, $I_3$ and $I_4$, the pins being displaced 45 degrees with respect to the 90 degree stylus intervals. When turret 17 is at its normally raised position, as shown in FIG. 7, and its stylus $S_1$ is in engagement with glass plate 13, then pins $I_1$ and $I_2$ are received in notches $N_1$ and $N_2$ formed in the lower edge of a holding strip 37 bridging panels $P_3$ and $P_4$ of carrier 28, thereby maintaining stylus $S_1$ in its operative position. But when stylus turret 17, which is carried on transverse rod 19, is depressed, then pin $I_3$ strikes an abutment 36 at the base of carrier 18.

As a consequence of this action, turret 17 is turned 90 degrees, and when actuator bar 16 is released, the turret rises in the cavity of carrier 18 until two of the pins ($I_2$ and $I_3$) are received in the notches of holding strip 37, thereby presenting the blank stylus $S_4$ to the glass plate. Thus each time the actuator bar is depressed, turret 17 is indexed, so that one can successively present styluses $S_1$, $S_2$, $S_3$ and $S_4$, the last stylus being a blank.

If, therefore, drawing is being carried out with a stylus $S_1$ and one wishes to interrupt this line, then the turret is indexed to present blank stylus $S_4$ and the knob turned to interrupt the line in a desired path until one wishes to again draw, at which point the turret is again indexed to present a writing stylus.

One of the styluses may be configured to draw not a thin line or a thick line but three parallel lines. This can be done by means of a stylus having four tips $T_1$, $T_2$, $T_3$ and $T_4$, as shown in FIG. 10, at the corners of a diamond. When, therefore, these tips engage the glass plate, lines $L_1$, $L_2$ and $L_3$ are drawn when this stylus is shifted in the longitudinal direction, for then tips $T_2$ and $T_4$ draw a common line $L_2$. And when the stylus is shifted in the transverse direction, then lines $L_4$, $L_5$ and $L_6$ are drawn, tips $T_1$ and $T_3$ drawing a common line $L_5$. Hence regardless of the direction of stylus movement, three lines are drawn by the array of four tips.

While there has been shown and described a preferred embodiment of a drawing device having indexable stylus turret in accordance with the invention, it will be appreciated that many changes and modifications may be made therein without, however, departing from the essential spirit thereof.

Thus instead of strings to shift the guides, the guides which run on rails $R_1$ and $R_2$ may be shifted by a first lead screw engaging a threaded bore in one of these guides turned by one knob. The guides which run on rails $R_3$ and $R_4$ are shifted by a second lead screw at right angles to the first screw which engages a threaded bore of one of these guides, the second lead screw being turned by a separate knob. Also, one may use as a screen material an acrylic plastic plate and ultrasonically weld it to the frame to prevent powder leakage from the case.

Screen Safety Sheet

In the above-identified Clark patent, in order to prevent any particles of the glass screen from falling out of the box of the drawing device should this screen be broken or shattered, a transparent plastic sheet is provided which completely covers the top of the box and is kept in place by the frame overlying the screen and by a pair of apertures near opposite corners of the sheet which surround the shafts of the driving knobs. If, therefore, the glass screen is accidentally caused to crack, the resultant particles of the glass will remain inside the chamber and no sharp edges will escape to injure the user of the device.

The practical drawback to this arrangement is that the safety sheet is held in place mainly by pressure marginally applied thereto by the frame. In time, as a result of frame warpage or other factors, the safety sheet may become partially released and cease to lie flat against the screen.

In the arrangement shown in FIG. 11, screen 38 of the drawing device is of acrylic or other plastic material that lends itself to ultrasonic welding, glass lacking this characteristic. Screen 38 is covered by a rectangular transparent sheet 39 of thermoplastic such as PVC. Sheet 39 is somewhat smaller in area than screen 38 so that the margin of rectangular screen 38 extends beyond the margin of sheet 39. Safety sheet 39 is ultrasonically welded in its marginal zone $W_1$ to screen 38 and is therefore permanently joined thereto.

Overlying the margin of safety sheet 39 and the margin of screen 38 is the top frame 40 of the drawing device whose underside is provided with indented shoulders to accommodate these margins. Acrylic screen 38 is ultrasonically welded to the underside of upper frame 40 in zone $W_2$.

The top frame 40 and the sheet-covered screen 38 welded thereto rest on a supporting frame 41. Frame 41 is ultrasonically welded to the margin of screen 38 at zone $W_3$ and to the underside of top frame 40 at zone $W_4$. Thus the arrangement is such as to fully seal the drawing device and prevent the escape of powder therefrom, and at the same time to protectively cover the acrylic screen so that in the event it shatters, the resultant pieces will be confined within the device.

In practice, first sheet 39 is ultrasonically welded at its margin to screen 38 and then screen 38 is marginally welded to top frame 40, after which top frame 40 and screen 38 are ultrasonically welded to supporting frame 41 to complete this sub-assembly.

We claim:

1. A drawing device for producing line drawings or sketches, said device comprising:

(a) a box-like case provided at its top with a transparent screen, said case being partly filled with a slightly adhesive powder that adheres to the undersurface of the screen to render it opaque;

(b) transverse and longitudinal rods disposed within the case, whereby the rods intersect at a point depending on the relative positions of the rods in the case;

(c) control means including first and second knobs operatively coupled to said rods whereby when the first knob is turned, the transverse rod is shifted toward either end of the case, and when the second knob is turned the longitudinal rod is shifted toward either side of the case;

(d) an indexable stylus turret and carrier assembly supported at the intersection of the rods, said turret which is received within the carrier being slidably supported on one rod and the carrier being slidably supported on the other rod whereby said assembly is caused to assume a position that depends on the point of intersection, said turret having a plurality of styluses at spaced positions on its rim, each stylus having a distinctive line drawing characteristic; and (e) indexing means including an actuator bar operatively coupled through said rods to said assembly to index said turret to present to the undersurface of said screen a selected one of said styluses.

2. A device as set forth in claim 1, wherein said plurality of styluses includes a stylus producing a thin line, a stylus producing a medium width line and a stylus producing a broad line.

3. A device as set forth in claim 1, wherein said plurality of styluses includes a stylus formed by four tips at the corners of a diamond to produce three parallel lines.

4. A device as set forth in claim 1, wherein said turret includes a blank stylus which when presented to said screen results in an interruption in the line then being drawn.

5. A device as set forth in claim 1, wherein the end portions of each rod are supported on respective slides ridable on parallel rails.

6. A device as set forth in claim 5, wherein the slides supporting each rod are fastened to a continuous string which is looped over pulleys, one of which is a drive pulley coupled to the related knob.

7. A device as set forth in claim 6, wherein each slide is provided with a guide stylus that engages the undersurface of the screen.

8. A device as set forth in claim 1, wherein said turret is received in a cavity of said carrier and said indexing means, when actuated, causes said turret to drop in said cavity to engage an abutment therein causing it to index.

9. A device as set forth in claim 8, wherein said turret is provided with lateral pins, each of which engages said abutment to cause indexing of the turret.

* * * * *